United States Patent [19]

Ryan

[11] 4,375,778

[45] Mar. 8, 1983

[54] RELOADER

[76] Inventor: Bruce A. Ryan, 68 Racicot Ave., Webster, Mass. 01570

[21] Appl. No.: 270,585

[22] Filed: Jun. 4, 1981

[51] Int. Cl.[3] ..... F42B 33/10

[52] U.S. Cl. ..... 86/36; 86/23; 86/25

[58] Field of Search ..... 86/23, 25, 32, 36, 37

[56] References Cited

U.S. PATENT DOCUMENTS

| | | | |
|---|---|---|---|
| 1,463,603 | 7/1923 | Talcott . | |
| 1,502,824 | 7/1924 | Hueter . | |
| 2,004,420 | 6/1935 | Siebert et al. | 86/23 |
| 2,061,977 | 11/1936 | Newcomb | 86/23 |
| 2,133,198 | 11/1938 | Jayne | 86/23 |
| 2,325,642 | 8/1943 | Turnock et al. | 86/23 |
| 2,775,157 | 12/1956 | Hunt, Jr. et al. | 86/23 |
| 2,819,644 | 1/1958 | Sorcoran | 86/23 |
| 2,829,553 | 4/1958 | Twidell | 86/36 |
| 3,105,408 | 10/1963 | Bachhuber | 86/25 |
| 3,113,463 | 12/1963 | Puth | 86/23 |
| 3,124,994 | 3/1964 | Kiess | 86/32 X |
| 3,157,086 | 11/1964 | Bachhuber | 86/27 |
| 3,240,104 | 3/1966 | Bachhuber | 86/39 |
| 3,702,089 | 11/1972 | Bachhuber | 86/32 |
| 3,750,528 | 8/1973 | Boddie | 86/37 |
| 4,163,410 | 8/1979 | Dillon | 86/23 |

FOREIGN PATENT DOCUMENTS

| | | | |
|---|---|---|---|
| 676890 | 12/1963 | Canada | 86/36 |

*Primary Examiner*—Leland A. Sebastian
*Attorney, Agent, or Firm*—Blodgett & Blodgett

[57] ABSTRACT

A reloader for a shotgun primer housing, comprising anvil means mounted on a platform for supporting the primer housing in either an upright position for removing the primer from the housing or in an inverted position for inserting a new primer into the housing. A punch is provided having an elongated tip portion which is capable of entering an aperture in the primer housing when it is in the inverted position for removing the primer from the housing and a ram is provided having a flat pressing surface for forcing a new primer into the housing through the upwardly-facing open bottom of the primer housing when the housing is supported on the anvil means in the inverted position.

10 Claims, 20 Drawing Figures

FIG. 1
PRIOR ART
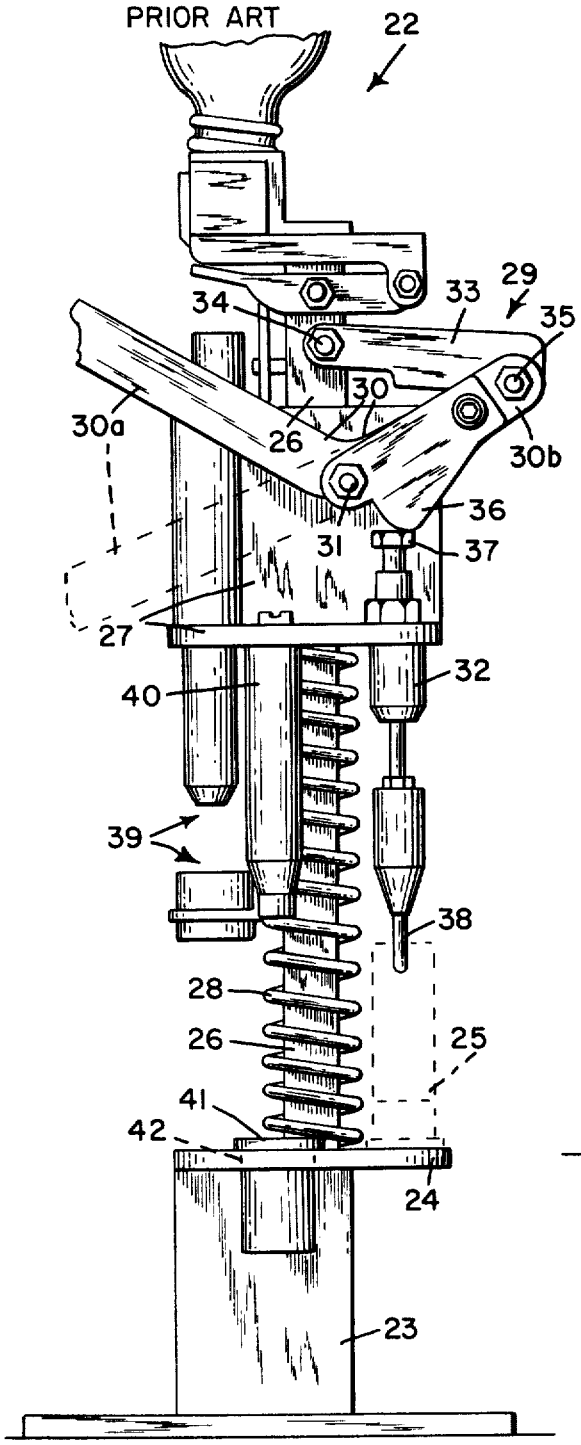
FIG. 2
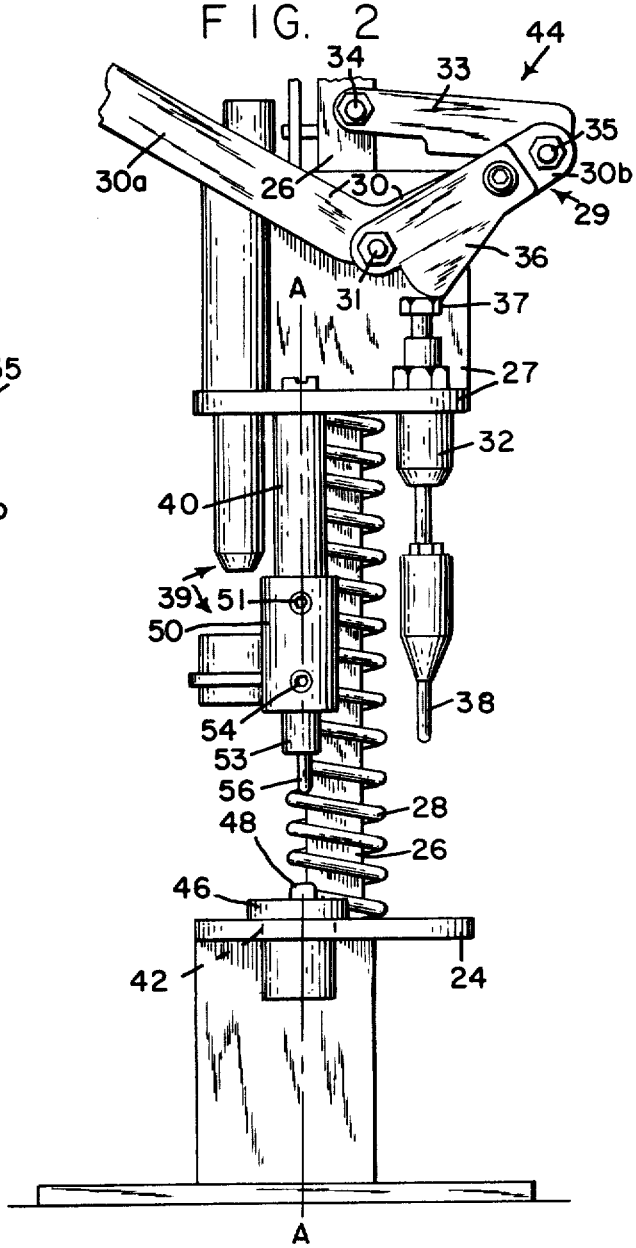
PRIOR ART
FIG. 3
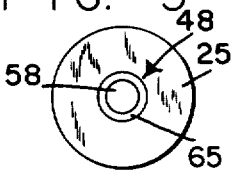
PRIOR ART
FIG. 4
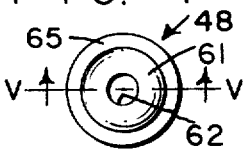
FIG. 6
PRIOR ART
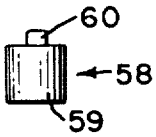
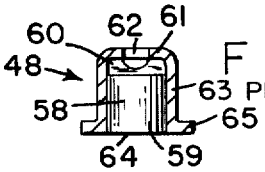
FIG. 5
PRIOR ART

RELOADER

BACKGROUND OF THE INVENTION

This invention relates generally to reloading apparatus for shotgun shells and, specifically, to reloading apparatus for shotgun shell primers.

Sportsmen who engage in trap shooting expend a great deal of ammunition during competitive events and during practice between such events. So much ammunition is used by the average trap shooter in the course of a year that it is common practice for trap shooters to reload previously-fired shotgun shells. Most trap shooters own one or more reloading machines for this purpose. A fired shot shell may be loaded by the reloading apparatus and fired several times. Since the price of ammunition has risen dramatically in the last few years, the trapshooter realizes a considerable savings by reloading his own shotgun shells.

Reloaders of the prior art are adapted to reload a shotgun shell in a series of successive steps. First, the previously-fired shotgun is supported in its upright position and a punch is driven downwardly through the empty shell to punch out the primer assembly. Next, a new primer assembly is then inserted into the base of the shell after which the shell is subsequently filled with powder, wadding, and shot. Finally, the top of the shell is crimped and the shell is ready for firing. The prior art reloaders, therefore, perform each of the basic steps in the process of loading a shotgun shell with the exception of reloading the primer per se. The entire primer assembly is replaced in reloading the shell. The old primer assembly (which includes the primer itself enclosed in a primer housing) is removed as a unit from the old shell and a new primer assembly is inserted in the shell as a first step in the process of reloading. The preloaded primer assemblies are purchased in volume but still represent a substantial portion of the total cost of reloading each shell, as much as 15%. On the other hand, the primers per se are relatively inexpensive as compared to the primer assemblies. However, none of the prior art reloaders provides for reloading the primer assemblies. These and other difficulties experienced with the prior art reloaders have been obiated by the present invention.

It is, therefore, an outstanding object of the invention to provide a reloader in which the primer housing is reloaded; that is to say, the spent primer is removed from the primer housing and a new primer is inserted thereinto.

Another object of the invention is the provision of adapter elements for an existing shotgun shell reloader that enables the reloader to reload primer housing.

Another object of the invention is the provision of adapter elements for an existing shotgun shell reloader that enables the reloader to reload primer housing.

A further object of the present invention is the provision of a reloader for primer housings which will reload two different types of housings.

It is another object of the instant invention to provide adapter elements which will perform the dual function of removing a spent primer from the housing and inserting a new primer into the housing.

A still further object of the invention is the provision of reloading apparatus for primer housing, which apparatus is simple in construction, inexpensive to manufacture, and capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a reloader for a shotgun primer housing having a top wall with a central aperture, a bottom opening, and an outer annular flange extending about the bottom opening. The reloader includes a horizontal platform, a vertical supporting column above the platform, a carriage slidably mounted on the column, and an actuating means for reciprocating the carriage toward and away from the platform. An anvil means is mounted on the platform for supporting the primer housing in either the upright position (in which the aperture faces upwardly) or in an inverted position (in which the bottom opening faces upwardly). A punch is removably attached to the carriage and includes an elongated tip portion which is capable of entering the primer housing aperture when the housing is in the upright position on the anvil means for dislodging the primer from the housing through the bottom opening and into a discharge opening which forms part of the anvil means. A ram having a flat ramming surface is also removably attachable to the carriage for engaging a primer placed in the bottom opening of a primer housing (which is supported on the anvil means in the inverted position) and for pressing the primer into the housing.

More specifically, the anvil means comprises a primary anvil having a cylindrical hole at the top thereof for receiving the primer housing and a horizontal annular ledge at the bottom of the hole for supporting the annular flange of the housing in the upright position. A secondary anvil rests on the primary anvil and has a locating pin which extends into the cylindrical hole of the primary anvil. The secondary anvil has a cylindrical cavity in its upper surface for receiving a primer housing in the inverted position, so that the annular flange remains above the upper surface of the secondary anvil to enable a primer to be inserted into the primer housing. The punch and ram are removably attachable to the carriage through a fixture which includes a bolt extending downwardly from the carriage and a chuck connected to the end of the bolt for holding the ram or punch.

BRIEF DESCRIPTION OF THE DRAWINGS

The character of the invention, however, may be best understood by reference to one of its structural forms, as illustrated by the accompanying drawings in which:

FIG. 1 is a side elevational view of a prior art shotgun shell reloader of the type to which the present invention is adapted, FIG. 2 is a fragmentary side elevational view of the reloader of FIG. 1 which is adapted in accordance with the present invention for removing a primer from a primer housing, FIG. 3 is a bottom plan view of a typical shotgun shell showing the primer and housing, FIG. 4 is a top plan view of a primer assembly, FIG. 5 is a vertical cross-sectional view taken on the line V—V of FIG. 4, FIG. 6 is a side elevational view of the primer per se.

DESCRIPTION OF THE PREFERRED EMBODIMENT

Figure 7:
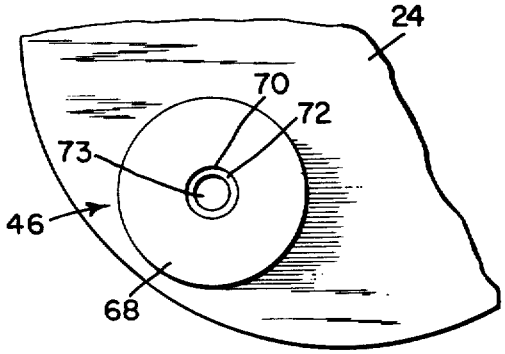
FIG. 7 is a fragmentary top plan view of the primary anvil mounted on the platform of the reloader.

Referring first to FIG. 1, there is shown a prior art shotgun reloader of the type shown and described in U.S. Pat. Nos. 3,105,408 and 3,157,026. The reloader shown in FIG. 1 is generally indicated by the reference numeral 22 and comprises a base 23 which includes a platform 24. A column 26 extends upwardly from the platform 24 and a carriage 27 is slidably supported for vertical movement on the column 26. A compression spring 28 supports the carriage 27 in the upper position shown in FIG. 1. An actuating mechanism, generally indicated by the reference numeral 29, is effective to lower the carriage 27 against the bias of spring 28. The actuating mechanism 29 comprises a bell-crank lever 30 consisting of a handle portion 30*a* and a connecting portion 30*b*. The bell-crank lever 30 is pivotally connected to the carriage 27 by a pivot pin 31 and is pivotally connected to one end of a link 33 by a pivot pin 35. The opposite end of link 33 is pivotally connected to the column 26 by a pivot pin 34. When the handle portion 38 is in the position shown in full lines in FIG. 1, the carriage 27 is in its uppermost position.

When the handle portion 30*a* is moved downwardly to the dotted line position shown in FIG. 1, the pivot pin 35 is moved toward the column 26. Link 33 and portion 30*b* move from the folded position in FIG. 1 to an open position which causes downward movement of the carriage 27. There are a plurality of attachments connected to the carriage 27 for performing various reloading functions, for example, a primer-removing punch 64 is slidably guided in a sleeve 32 and extends downwardly from the carriage 27. As the carriage 27 moves downwardly, the punch 38 enters the empty shell 25 that has been placed on the platform 24 until it strikes the base of the shell. Continued downward movement of the carriage 27 causes the punch 38 to move upwardly through the sleeve 32. A cam follower 37 is attached to the upper end of the punch and engages a cam 36 fixed to the portion 38*b* of the bell-crank lever 30. As the handle portion 30*a* is moved from the full line position to the dotted line position in FIG. 1, cam 36 swings upwardly away from the pivot pin 31 but not as fast as the carriage 27 moves downwardly, so that the punch 38 is given an additional downward movement by the cam 36 to punch the primer housing out of the empty shell 25. The carriage also supports a crimping tool, generally indicated by the reference numeral 39, and a bolt 40 for resetting a new primer into the empty shell 25. For this operation, the empty shell 25 (with its old primer removed) is placed on an anvil 41 which sets into an opening 42 in the platform 24. A new primer is placed in a depression, not shown, in the upper surface of anvil 41 and the empty shell 25 is placed on top of the anvil 41. The carriage 27 is lowered, so that bolt 40 enters the empty shell 25 until it reaches the base of the shell. Continued downward motion of the carriage 27 causes the new primer to be forced into the base of the shell.

Referring particularly to FIG. 2, the basic reloader 22, shown in FIG. 1, has been adapted for reloading a shotgun shell primer housing and, particularly for removing a primer from its housing. The adapted reloader shown in FIG. 2, is generally indicated by the reference numeral 44. As shown in FIG. 2, the anvil 41 has been replaced by a primary anvil 46 which extends into the opening 42 for supporting a primer housing 48 in its upright position. A chuck 50 is mounted on the end of bolt 40 by means of a set screw 51 and a punch 53 is mounted in the bottom end of the chuck 50 and held in place by a set screw 54. The punch 53 has an elongated tip portion 56 extends downwardly in vertical alignment with an aperture in the top of the primer housing 48.

Referring particularly to FIGS. 4 and 5, the primer housing consists of a top wall 61 provided with a central aperture 62, a cylindrical side wall 63, bottom opening 64, and an annular flange 65 extending about the bottom opening 64. The primer, indicated generally by the reference numeral 58, fits inside the housing 48 and includes a main body portion 59 and a narrow striker portion 60 which is shown in the end position in FIG. 6. The primer 58 and housing 48 constitutes a primer assembly which fits into the base of the shotgun shell 25, as shown in FIG. 3. This entire assembly is removed from the empty shotgun shell by the punch 38.

Figure 8:
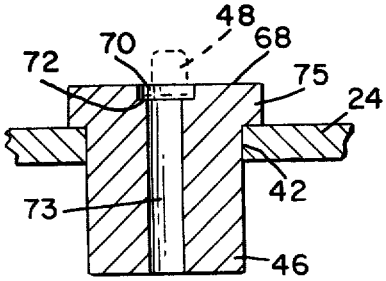
FIG. 8 is a fragmentary vertical cross-sectional view of the primary anvil taken on the line VIII—VIII of FIG. 7.
Figure 9:
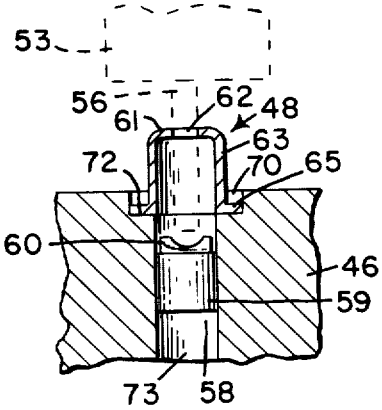
FIG. 9 is a fragmentary vertical cross-sectional view of a primer housing supported on the primary anvil and showing a primer being removed from the housing.

Referring particularly to FIGS. 7-9, the primary anvil 46 is shown in greater detail. The primary anvil has an upper surface 68 provided with a cylindrical hole 70 and a horizontal annular ledge 72 at the base of the hole 70 for supporting the flange 65 of a primer housing as shown in FIGS. 8 and 9. A discharge opening 73 extends from the annular ledge 72 down through the bottom of a primary anvil 46. As shown in FIG. 8, the main portion of anvil 46 fits into the hole 42 in the platform 24 and is supported on the platform by means of an annular flange 75 at the top of the anvil.

Figure 10:
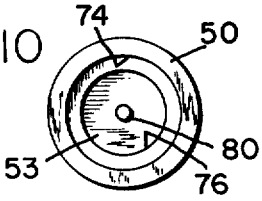
FIG. 10 is a top plan view of the chuck which supports the punch and ram and showing the punch in the chuck.
Figure 11:
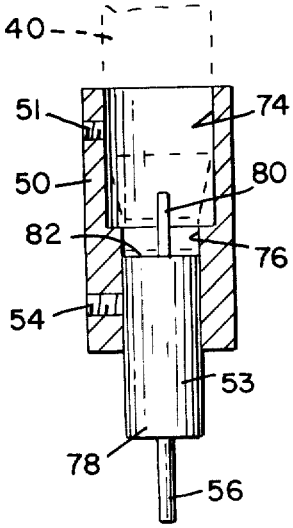
FIG. 11 is a vertical cross-sectional view of the chuck taken on the line XI—XI of FIG. 10 and showing the punch in operative position.

Referring to FIGS. 2, 10, and 11, the chuck 50 is provided with an upper bore 74 which fits over the bottom of the bolt 40, as shown in FIG. 11 and a lower bore 76 which is adapted to receive the punch 53. An elongated tip portion 56 extends from a first end portion 78 of the punch 53 and a second tip portion 80 extends from a second end portion 82 of the punch. The elongated tip portions 56 and 80 are in the shape of cylindrical pins. The tip portions 56 and 80 have different diameters, so that the punch 53 can be used with two different types of primers, one with a relatively large central aperture 62 and one with a relatively small aperture 62. The punch 53 is mounted in the chuck 50, so that the large tip portion 56 extends downwardly for removing the primer from a primer housing having a relatively large aperture. When dealing with a primer housing having a relatively small central aperture 63, the punch 53 is inverted from the position shown in FIG. 11, so that the relatively small diameter tip portion 80 extends downwardly.

Figure 12:
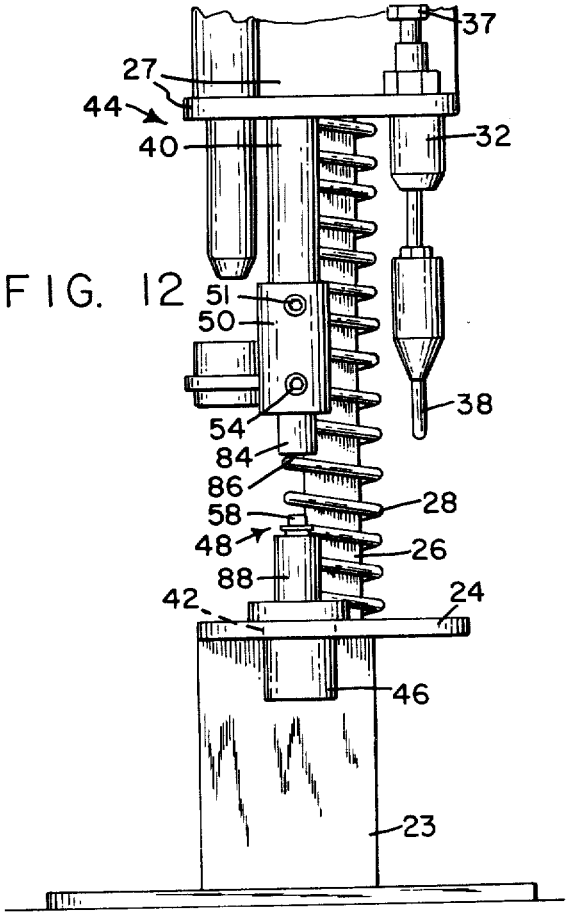
FIG. 12 is a view similar to FIG. 2 of the reloader of FIG. 1 which is adapted in accordance with the principles of the present invention for inserting a primer into an empty primer housing.

Referring particularly to FIG. 12, the reloader 44 is shown as set up for inserting a primer into an empty primer housing. The punch 53 has been replaced in the chuck 50 by a ram 84 which has lower flat pressing surface 86 (see also FIG. 16). A secondary anvil 88 is mounted on the primary handle 46 for supporting a primer housing 48 in its inverted position, as shown in FIG. 12.

Figure 14:
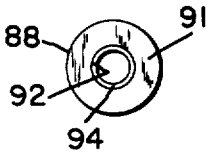
FIG. 14 is a plan view thereof.
Figure 13:
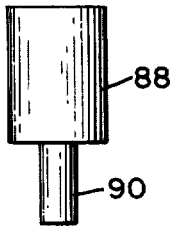
FIG. 13 is a side elevational view of the secondary anvil for supporting the primer housing in its inverted position.
Figure 15:
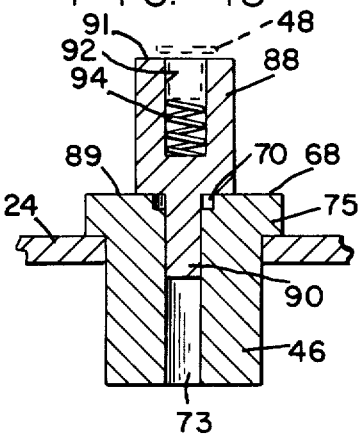
FIG. 15 is a fragmentary cross-sectional view of the secondary anvil mounted on the primary anvil.
Figure 17:
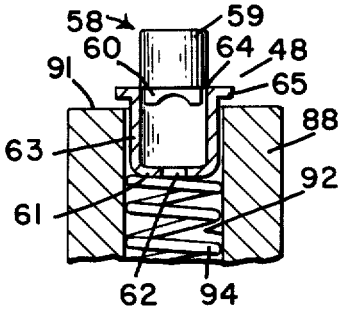
FIG. 17 is a fragmentary cross-sectional view of the primer housing mounted on the secondary anvil is inverted position and showing a primer positioned in the upwardly-facing bottom opening of the housing.
Figure 18:
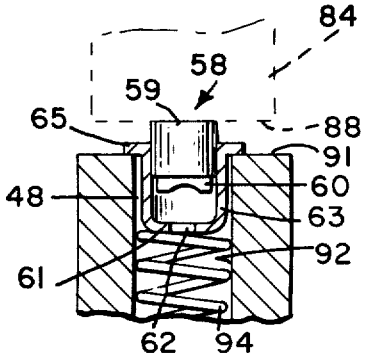
FIG. 18 is a similar view showing the primer partially inserted into the primer housing.

Referring particularly to FIGS. 13–15, the secondary anvil 88 includes a locating pin 90 extending downwardly from a bottom surface 89 and a cylindrical cavity 92 in a top surface 91. The locating pin 90 fits into the discharge opening 73 of the primary anvil, so that a bottom surface 89 of the secondary anvil rests on the upper surface 68 of the primary anvil, as shown in FIG. 15. A spring 94 is located in the lower portion of the cylindrical cavity 92, so that, when a primer housing 48 is inserted in the cylindrical cavity 92, the spring 94 normally biases the primary housing upwardly in such a way that the annular flange 65 lies slightly above the upper surface 68 of the primary anvil, see also FIG. 17. During a "recharge" operation, the new primer 58 is placed on top of the inverted primer housing 48 so that the striker portion 60 extends into the housing, as shown in FIG. 17. The carriage 27 is then lowered so that the pressing surface 86 of the ram 84 engages the primer 58 against the bias of spring 94 and pushes the primer 58 into the interior of the housing 63, as shown in FIG. 18.

The operation and advantages of the present invention will now be readily understood in view of the above description. Assuming that the operator has a large number of spent primer assemblies which have been removed from fired shotgun shells and wishes to renew these primer assemblies with fresh primers, the reloader 44 is set up, as shown in FIG. 2, to first remove the old or spent primers from the housings 48. A primer housing 48 containing a spent primer is first placed in the opening 70 in the upright position, so that the flange 65 rests on the ledge 72, as shown in FIGS. 8 and 9. In this position, the aperture 62 of the housing is vertically aligned along a vertical axis A—A which extends through the central longitudinal axis of the bolt 40. The punch 53 is located within the lower bore 76 of the chuck, as shown in FIG. 11, so that the central longitudinal axis of the elongated tip portion 56 also extends along vertical axis A—A. The handle portion 30*a* of the bell-crank lever 30 is moved downwardly from its full line position to its dotted line position, as shown in FIG. 2. The tip portion 56 is brought down through aperture 62 of the primer housing 48 to punch the primer 59 through the bottom opening 64 and into the discharge opening 73 of the primary anvil 46, as shown in FIG. 9. The punch 53 is then raised by lifting the handle portion 30*a* from the dotted line position to the full line position, as shown in FIG. 2 and a new housing 48 containing a spent primer is placed in the cylindrical hole 70 of the primary anvil 46. This sequence is continued for a desired number of primer housings which contain spent primers until a supply of empty housings 48 have accumulated.

Figure 16:
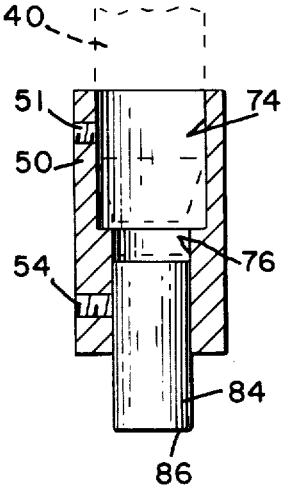
FIG. 16 is a side elevational view of the ram mounted in the chuck, which is shown in cross-section.

Referring first to FIG. 12, the reloader 44 is shown as arranged to insert a new primer into an empty primer housing. Second anvil 88 is placed on top of the primary anvil 46 (see also FIGS. 12 and 15) and the empty primer housing 48 is placed into the cylindrical cavity 92, as shown more clearly in FIG. 17. The punch 53 is removed from the chuck 50 and the ram 84 is inserted into the lower bore 76, as shown in FIG. 16. The bottom opening 64 of the primer housing 48 is coaxial with the vertical axis A—A. The central longitudinal axis of the punch 84 also extends along the vertical axis A—A. The new primer 58 is placed over the bottom opening 64 of the primer housing, so that the striker portion 60 of the primer extends into the housing as shown in FIG. 17. The ram 84 is lowered by the actuating means 29; at that time the bottom surface 86 of the punch engages the primer 58 and forces the primer into the housing 63, as shown in FIG. 18. The ram 84 is then raised and the spring 94 lifts the recharged primer assembly, so that the annular flange 65 of the housing is lifted above the upper surface 91 of the secondary anvil, as shown in FIG. 17. This enables the recharger primer assembly to be easily removed from cavity 92 by grasping the flange 68 with the ends of the fingers. A new empty primer housing 48 is then inserted into cavity 92 and the above process is repeated until all of the primer housings are charged with fresh primers.

Figure 20:
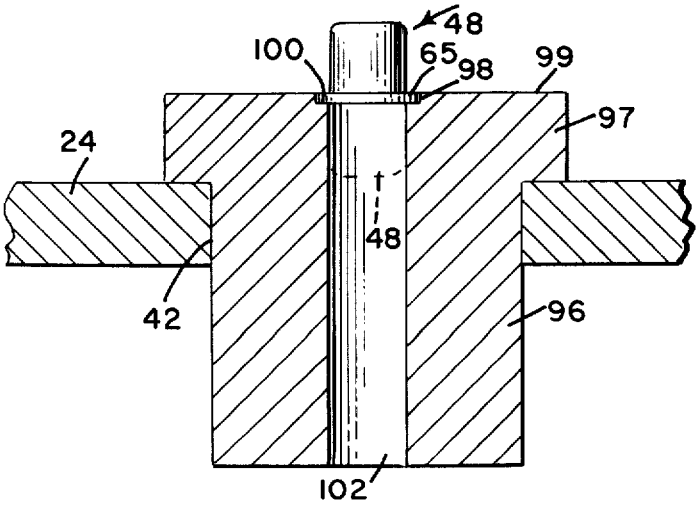
FIG. 20 shows a modified anvil means which is capable of supporting the primer housing either in its upright or inverted position.

FIG. 20 shows a modified anvil 96 which fits into the opening 42 in the platform 24 in the same manner as the primary anvil 46. The modified anvil 96 has an upper flange 97 which supports the anvil on the platform 24. Anvil 96 has an upper surface 99 provided with a cylindrical hole 98 and a horizontal annular ledge 100 at the base of the hole. The discharge opening 102 extends from the ledge 100 through the bottom of the anvil 96. The depth of hole 98 is approximately equal to the thickness of the annular flange 65 of the primer housing 48 and the diameter of the discharge opening 102 is slightly greater than the diameter of the cylindrical side wall 63 of the primer housing, so that the primer 48 can be supported on the anvil 96 in either its upright position or its inverted position. In either position, the annular flange 65 of the primer housing rests on the ledge 100, as shown in FIG. 20. The upright position of the primer housing 48 is shown by full lines in FIG. 20 and the inverted position of the primer housing is shown by dotted lines in that figure. The primer housing 48 containing a spent primer is placed in the cylindrical hole 98 so that the flange 65 is supported on the ledge 100, as shown in full lines in FIG. 20. The primer housing 48 is positioned to receive the punch 56 in the same manner as illustrated in FIG. 9 for discharging the primer 59 into the discharge opening 102. A fresh primer is inserted into the primer housing 48 by inverting the primer housing so that the cylindrical sidewall 63 extends into the discharge opening as indicated by dotted lines in FIG. 20. In this position, the annular flange 65 is also supported on the ledge 100 so that the bottom opening 64 of the primer housing faces upwardly to receive a fresh primer 58 in the same manner as illustrated in FIG. 17. The new primer 58 is then pressed into the primer housing by the ram 84 in the same manner as illustrated in FIG. 18.

Figure 19:
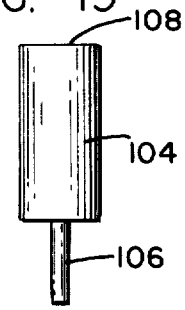
FIG. 19 shows a modification in which the punch and ram form an integral unit.

Referring particularly to FIG. 19, there is shown a modified punch-ram element 104 which is adapted for the dual purpose of pressing out a "used" primer or ramming in a "new" primer. The punch-ram element 104 comprises an elongated tip portion 106 at one end and a flat ramming surface 108 at its opposite end. The elongated tip portion 106 is similar to the tip portion 56 of the punch 53 and the flat ramming surface 108 is similar to the flat ramming surface 86 of the ram 84. When the punch-ram element 104 is used as a punch, it is inserted into the chuck 50 with the elongated tip portion 106 facing downwardly. In this position, the punch-ram element 104 functions as a punch in exactly the same manner as punch 53. When the punch-ram element 104 is to be used as a ram, it is inserted into the chuck 50, so that the surface 108 faces downwardly. In this position, the punch-ram 104 functions as a ram in exactly the same manner as punch 84.

The modified anvil 96 may be used in combination with the punch 53 or the modified punch-ram element 104. Punch-ram element may be used in combination with primary anvil 46 and the secondary anvil 88 or the modified anvil 96. When the modified anvil 96 is used with the punch-ram 104 and chuck 50, no other elements are required for reloading a primer housing, including the step of removing a spent primer from the housing and the step of inserting a new primer in the housing.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Reloader for a shotgun primer housing having a cylindrical side wall, a top wall with a central aperture, a bottom opening and an outer annular flange extending about the bottom opening, the spent primer to be removed from the housing and the new primer to be inserted in the housing being of the type which is a complete primer assembly consisting of a striker portion mounted in a main body portion, said reloader comprising:

(a) a supporting base including a horizontal platform;
(b) a vertical supporting column extending upwardly from the platform;
(c) a carriage slidably mounted on the column for vertical motion;
(d) actuating means for reciprocating the carriage toward and away from the platform;
(e) a primary anvil mounted on the platform and having:
  (1) an upper surface,
  (2) a cylindrical hole extending downwardly from the upper surface and having a larger diameter than the annular flange of the primer housing,
  (3) a horizontal annular ledge at the bottom of said hole and located above said discharge opening for supporting the annular flange of a primer housing in the upright position in which the aperture faces upwardly for removal of the spent primer, and
  (4) a discharge opening below said annular ledge for receiving a spent primer which is dislodged from the housing;
(f) a secondary anvil having:
  (1) a bottom surface which rests on the upper surface of the primary anvil,
  (2) a locating pin extending downwardly from the bottom surface and being insertable into the hole of the primary anvil,
  (3) a top surface, and
  (4) a cylindrical cavity in the top surface for receiving a primer housing in the inverted position in which the bottom opening faces upwardly so that the annular flange remains above the top surface to enable a new primer to be inserted into the housing, said primary and secondary anvils constituting anvil means which are effective to maintain the aperture and bottom opening of the housing in vertical alignment with a vertical axis;
(g) a punch having an elongated tip portion which is capable of entering the primer housing aperture, said punch being removably attachable to the carriage so that downward movement of the carriage causes the tip portion to move downwardly along said vertical axis into the aperture of a primer housing supported on the anvil in the upright position for dislodging the spent primer from said housing into the bottom opening; and
(h) a ram having a flat ramming surface and being removably attachable to the carriage so that downward movement of the carriage causes the flat ramming surface to move downwardly along said vertical axis for engaging a new primer placed in the bottom opening of a primer housing which is supported on the anvil means in the inverted position and for ramming the new primer into the housing.

2. Reloader as recited in claim 1, wherein the cavity has a larger diameter than the side wall of the primer housing and a smaller diameter than the annular flange of the housing, the depth of the cavity being greater than the length of the primer housing so that the flange is supported by the top surface of ramming a primer into the housing, said secondary anvil having a spring in the cavity for maintaining the flange spaced from the top surface in the absence of downward pressure from the ram.

3. Reloader as recited in claim 1, wherein the punch and ram are removably attachable to the carriage through a fixture comprising:

(a) a bolt extending downwardly from the carriage along said vertical axis; and
(b) a chuck connected to the end of the bolt for holding the ram or the punch.

4. Reloader as recited in claim 1, wherein the punch comprises:

(a) a main body having two opposite end portions, each of said end portions being adapted to be held by the chuck, said elongated tip portion extending from one of said end portions and constituting a first tip portion; and
(b) a second elongated tip portion extending from the other of said end portions and differing from the first tip portion in cross-sectional area so that the ram punch be used with two types of primer housings which differ in the size of their apertures.

5. Reloader as recited in claim 1, wherein the punch and ram are removably attachable to the carriage through a fixture comprising:

(a) a bolt extending downwardly from the carriage along said vertical axis;

(b) a chuck connected to the end of the bolt; and (c) a main body having two opposite end portions, each of said end portions being adapted to be held by the chuck, one of said end portions having said flat ramming surfaces and constituting said ram, the other of said end portions having said elongated tip portion and constituting said punch.

6. Adaptor for a shotgun shell reloader for adapting the reloader to reload a primer housing having a cylindrical side wall, a top wall with a central aperture, a bottom opening and an outer annular flange extending about the bottom opening, the spent primer to be removed from the housing and the new primer to be inserted in the housing being of the type which is a complete primer assembly consisting of a striker portion mounted in a main body portion, the shotgun shell reloader having a supporting base including a horizontal platform, a vertical supporting column extending upwardly from the platform, a carriage slidably mounted on the platform for vertical movement, and actuating means for reciprocating the carriage toward and away from the platform, said adaptor comprising:

(a) a primary anvil mounted on the platform and having:

(1) an upper surface, (2) a cylindrical hole extending downwardly from the upper surface and having a larger diameter than the annular flange of the primer housing, (3) a horizontal annular ledge at the bottom of said hole and located above said discharge opening for supporting the annular flange of a primer housing in the upright position in which the aperture faces upwardly for removal of the spent primer, and (4) a discharge opening below said annular ledge for receiving a spent primer which is dislodged from the housing.

(b) a secondary anvil having:

(1) a bottom surface which rests on the upper surface of the primary anvil, (2) a locating pin extending downwardly from the bottom surface and being insertable into the hole of the primary anvil, (3) a top surface, and (4) a cylindrical cavity in the top surface for receiving a primer housing in the inverted position in which the bottom opening faces upwardly so that the annular flange remains above the top surface to enable a new primer to be inserted into the housing, said primary and secondary anvils constituting anvil means which are effective to maintain the aperture and bottom of the housing in vertical alignment with a vertical axis, (c) a punch having an elongated tip portion which is capable of entering the primer housing aperture, said punch being removably attachable to the carriage so that downward movement of the carriage causes the tip portion to move downwardly along said vertical axis into the aperture of a primer housing supported on the anvil in the upright position for dislodging the primer from said housing into the bottom opening; and (d) a ram having a flat ramming surface and being removably attachable to the carriage so that downward movement of the carriage causes the flat ramming surface to move downwardly along said vertical axis for engaging a primer placed in the bottom opening of a primer housing which is supported on the anvil means in the inverted position and for ramming the primer into the housing.

7. Adaptor as recited in claim 6, wherein the cavity has a larger diameter than the side wall of the primer housing and a smaller diameter than the annular flange of the housing, the depth of the cavity being greater than the length of the primer housing so that the flange is supported by the top surface for ramming a primer into the housing, said secondary anvil having a spring in the cavity for maintaining the flange spaced from the top surface in the absence of downward pressure from the ram.

8. Adaptor as recited in claim 6, wherein the reloader is provided with a bolt extending downwardly from the carriage along said vertical axis, the adaptor comprising a chuck which is attachable to the end of the bolt for releasably holding the ram or the punch.

9. Reloader as recited in claim 6, wherein the punch comprises:

(a) a main body having two opposite end portions, each of said end portions being adapted to be held by the chuck, said elongated tip portion extending from one of said end portions and constituting a first tip portion; and (b) a second elongated tip portion extending from the other of said end portions and differing from the first tip portion in cross-sectional area so that the ram can be used with two types of primer housings which differ in the size of their apertures.

10. Reloader as recited in claim 6, wherein the punch and ram are removably attachable to the carriage through a fixture comprising:

(a) a bolt extending downwardly from the carriage along said vertical axis;

(b) a chuck connected to the end of the bolt; and (c) a main body having two opposite end portions, each of said end portions being adapted to be held by the chuck, one of said end portions having said flat ramming surfaces and constituting said ram, the other of said end portions having said elongated tip portion and constituting said punch.

* * * * *